US006187140B1

(12) United States Patent
Anderson et al.

(10) Patent No.: US 6,187,140 B1
(45) Date of Patent: Feb. 13, 2001

(54) CREPING PROCESS UTILIZING LOW TEMPERATURE-CURING ADHESIVE

(75) Inventors: Ralph Anderson, Marietta, GA (US); Christopher Lee Davidson, Marysville, WA (US); Kenneth Curtis Larson, Appleton, WI (US); Thomas C. Saffel, Alpharetta; Robert Emil Weber, Marietta, both of GA (US); Duane K. Zacharias, Neenah, WI (US)

(73) Assignee: Kimberly-Clark Worldwide, Inc., Neenah, WI (US)

( * ) Notice: Under 35 U.S.C. 154(b), the term of this patent shall be extended for 0 days.

(21) Appl. No.: 09/207,319

(22) Filed: Dec. 7, 1998

Related U.S. Application Data

(60) Provisional application No. 60/070,084, filed on Dec. 31, 1997.

(51) Int. Cl.[7] ..... B31F 1/12; D21H 19/16

(52) U.S. Cl. ..... 162/112; 162/112; 162/127; 162/135; 162/146

(58) Field of Search ..... 162/127, 112, 162/146, 111, 113, 134, 135

(56) References Cited

U.S. PATENT DOCUMENTS

| | | | |
|---|---|---|---|
| 3,261,796 | 7/1966 | Simms | 260/29.6 |
| 3,702,785 | 11/1972 | Knechtges et al. | 117/155 |
| 3,753,826 | 8/1973 | Plummer | 156/277 |
| 3,879,257 | 4/1975 | Gentile et al. | 162/112 |
| 3,898,123 | 8/1975 | Phillips et al. | 162/134 |
| 4,063,995 | 12/1977 | Grossman | 162/112 |
| 4,121,966 | 10/1978 | Amano et al. | 162/164 R |

(List continued on next page.)

FOREIGN PATENT DOCUMENTS

| | | |
|---|---|---|
| 0062338 | 10/1982 | (EP) . |
| 0105598 | 4/1984 | (EP) . |
| 0 163 151 | 5/1985 | (EP) . |

OTHER PUBLICATIONS

Japanese Abstract, JP 6001939, Toyo Ink Mfg. Co.

Japanese Abstract, JP 61055274, Dainichiseika Color Chem.

Japanese Abstract, JP 62231787, Toray Ind. Inc.

Japanese Abstract, JP 6212081, Nippon Shokubai Co. Ltd.

Japanese Abstract, JP 04 146296 A, Arakawa Chem Ind Ltd.

International Search Report US 98/27738, Dec. 28, 1998.

*Primary Examiner*—Steve Alvo
(74) *Attorney, Agent, or Firm*—Karl V. Sidor

(57) ABSTRACT

A method of increasing the wet strength of a creped sheet, which method involves providing a sheet which includes cellulosic fibers, which sheet has a first side and a second side; applying a low temperature-curing latex adhesive binder composition to the first side of the sheet in a fine, spaced-apart pattern occupying from about 20 to about 50 percent of the surface area of the sheet; adhering the first side of the sheet to a creping surface; and creping the sheet from the creping surface. The binder composition is adapted to adhere the sheet to the creping surface and includes a functional group-containing latex, a functional group-reactive crosslinking agent, and a volatile base. In addition, the creping surface is heated at a temperature no greater than about 100° C. The low temperature-curing latex adhesive binder composition is adapted to have cured to a level, by the time the sheet is removed from the creping surface, which imparts to the creped sheet a cross-direction wet tensile strength which is at least about 50 percent that of an identical creped sheet which has been heated at about 150° C. for three minutes, in which the cross-direction wet tensile is tested in accordance with TAPPI Test Methods T494om-88 and T456om-87. In addition, the cross-direction wet tensile strength of the creped sheet is at least about 40 grams per centimeter.

29 Claims, 1 Drawing Sheet

U.S. PATENT DOCUMENTS

| | | | |
|---|---|---|---|
| 4,215,175 | 7/1980 | Tucker | 428/375 |
| 4,431,768 | 2/1984 | Wessling et al. | 524/543 |
| 4,457,980 | 7/1984 | Daniels et al. | 428/196 |
| 4,507,342 | 3/1985 | Kielbania, Jr. | 428/90 |
| 4,656,217 | 4/1987 | Sugiura et al. | 524/430 |
| 4,977,219 * | 12/1990 | Watson, Jr. | 525/329.5 |
| 5,087,646 | 2/1992 | Tork et al. | 523/406 |
| 5,246,544 | 9/1993 | Hollenberg et al. | 162/111 |
| 5,690,787 | 11/1997 | Hultman et al. | 162/112 |

* cited by examiner

CREPING PROCESS UTILIZING LOW TEMPERATURE-CURING ADHESIVE

This is a Continuation of Provisional Application Ser. No. 60/070,084, filed Dec. 31, 1997.

BACKGROUND OF THE INVENTION

The present invention relates to processes for creping a cellulosic web and to paper wiping products prepared thereby.

Absorbent paper products such as paper towels, industrial wipers, and the like generally are designed to have high bulk, a soft feel, and high absorbency. Desirably, these paper wiping products will exhibit high strength, even when wet, and resist tearing. Further, such products should have good stretch characteristics, should be abrasion resistant, and should not prematurely deteriorate in the environment in which they are used.

In the past, many attempts have been made to enhance certain physical properties of paper wiping products. Unfortunately, steps taken to increase one property often adversely affect other characteristics. For example, in pulp fiber-based wiping products, softness may be increased by inhibiting or reducing interfiber bonding within the paper web. Inhibiting or reducing fiber bonding, however, adversely affects the strength of the product.

One process which has proven successful in producing paper towels and other wiping products is disclosed in U.S. Pat. No. 3,879,257 to Gentile et al., which patent is incorporated herein by reference in its entirety. Gentile et al. disclose a process for producing a soft, absorbent, single ply fibrous web having a laminate-like structure. The fibrous web is formed from an aqueous slurry of primarily lignocellulosic fibers under conditions which reduce interfiber bonding. A bonding material, such as a latex elastomeric composition, is applied to a first surface of the web in a spaced-apart pattern. The bonding material provides strength to the web and abrasion resistance to the surface. The bonding material may be applied in a like manner to a second surface of the web to provide additional strength and abrasion resistance. After applying bonding material to the second surface, the web may be brought into contact with a creping surface, such as the cylinder surface of a Yankee dryer. The bonding material will cause the web to adhere to the creping surface. The web then is creped from the creping surface with a doctor blade. Creping the web mechanically debonds and disrupts the fibers within the web, except where bonding material is present, thereby increasing the softness, absorbency, and bulk of the web. If desired, both sides of the web may be creped sequentially after the pattern of bonding material has been applied.

Gentile et al. describe the optional use in the process of one or more curing or drying stations before the web is wound into what is referred to as a parent roll. As a practical matter, curing or drying is necessary in order to prevent the layers in the parent roll from sticking or adhering to one another (a phenomenon referred to in the art as "blocking"). Moreover, unless the web is cooled before it is wound into the parent roll, spontaneous combustion may occur. As is well known by those having ordinary skill in the art, drying is an energy-intensive step, particularly when two curing or drying stations are employed. The presence of curing or drying stations also adds to the capital cost of the process equipment. Similarly, the need for a cooling station or chill roll adds to both capital and operating costs.

The presence of curing or drying stations also limits the types of noncellulosic fibers which may be present in the web. Such stations typically are operated at temperatures of the order of 150° C. These temperatures preclude the presence in the web of synthetic polymer fibers prepared from, by way of example only, polyolefins.

Thus, there is a need for a creping process which would permit the development of sufficient strength and other desirable attributes without an energy-intensive curing step. There also is a need for a creping process which would permit the use of a wider variety of synthetic polymeric fibers.

SUMMARY OF THE INVENTION

The present invention addresses some of the difficulties and problems discussed above by providing a method of increasing the wet strength of a creped sheet. The method involves providing a sheet which includes cellulosic fibers, which sheet has a first side and a second side; applying a low temperature-curing latex adhesive binder composition to the first side of the sheet in a fine, spaced-apart pattern occupying from about 20 to about 50 percent of the surface area of the sheet; adhering the first side of the sheet to a creping surface; and creping the sheet from the creping surface.

In general, the sheet has a basis weight of from about 40 to about 10 grams per square meter (gsm). The low temperature-curing latex adhesive binder composition is adapted to adhere the sheet to the creping surface. The composition includes a functional group-containing polymer in the form of a latex (sometimes referred to hereinafter as a functional group-containing latex), a functional group-reactive crosslinking agent, and a volatile base. In addition, the creping surface is heated at a temperature no greater than about 100° C. The low temperature-curing latex adhesive binder composition is adapted to have cured to a level, by the time the sheet is removed from the creping surface, which imparts to the creped sheet a cross-direction wet tensile strength which is at least about 50 percent that of an identical creped sheet which has been heated at about 150° C. for three minutes, in which the cross-direction wet tensile is tested in accordance with TAPPI Test Methods T494om-88 and T456om-87. In addition, the cross-direction wet tensile strength of the creped sheet is at least about 40 grams per centimeter.

In certain embodiments, the sheet may include up to about 20 percent by weight, based on the dry weight of cellulosic fibers, of synthetic polymer fibers. For example, the sheet may include from about 5 to about 10 percent by weight, based on the dry weight of cellulosic fibers, of synthetic polymer fibers. By way of example, the synthetic polymer fibers may be polyester fibers or polyolefin fibers. Examples of polyolefin fibers include polyethylene and polypropylene fibers.

In some embodiments, the functional groups of the functional group-containing latex will be carboxy groups. For example, the functional group-containing polymer may have an acid value of from about 15 to about 50 milligrams of potassium hydroxide per gram of polymer (mg KOH per g). As another example, the functional group-containing latex may be a polyacrylate. Also by way of example, the functional group-reactive crosslinking agent may be an aziridine oligomer having at least three aziridine groups. The functional group-reactive crosslinking agent may be present, by way of example, in an amount of from about 1 to about 8 percent by weight, based on the amount of the functional group-containing latex.

The present invention also provides a method of increasing the wet strength of a creped sheet, which method involves providing a sheet which includes cellulosic fibers, the sheet having a first side and a second side; applying a first low temperature-curing latex adhesive binder composition to the first side of the sheet in a fine, spaced-apart pattern occupying from about 20 to about 50 percent of the surface area of the sheet; applying a second low temperature-curing latex adhesive binder composition to the second side of the sheet in a fine, spaced-apart pattern occupying from about 20 to about 50 percent of the surface area of the sheet; adhering the second side of the sheet to a creping surface; and creping the sheet from the creping surface.

The sheet generally has a basis weight of from about 40 gsm to about 100 gsm.

The first low temperature-curing latex adhesive binder composition includes a first functional group-containing latex, a first functional group-reactive crosslinking agent, and a first volatile base. The second low temperature-curing latex adhesive binder composition is adapted to adhere the sheet to the creping surface and includes a second functional group-containing latex, a second functional group-reactive crosslinking agent, and a second volatile base. The creping surface is heated at a temperature no greater than about 100° C. The low temperature-curing latex adhesive binder composition is adapted to have cured to a level, by the time the sheet is removed from the creping surface, which imparts to the creped sheet a cross-direction wet tensile strength which is at least about 50 percent that of an identical creped sheet which has been heated at about 150° C. for three minutes, in which the cross-direction wet tensile is tested in accordance with TAPPI Test Methods T494om-88 and T456om-87. The cross-direction wet tensile strength of the creped sheet is at least about 60 grams per centimeter.

In certain embodiments, the sheet may include up to about 20 percent by weight, based on the dry weight of cellulosic fibers, of synthetic polymer fibers. For example, the sheet may include from about 5 to about 10 percent by weight, based on the dry weight of cellulosic fibers, of synthetic polymer fibers. By way of example, the synthetic polymer fibers may be polyester fibers or polyolefin fibers. Examples of polyolefin fibers include polyethylene and polypropylene fibers.

In some embodiments, the functional groups of the functional group-containing latex will be carboxy groups. For example, the functional group-containing polymer may have an acid value of from about 15 to about 50 mg KOH per g. As another example, the functional group-containing latex may be a polyacrylate. Also by way of example, the functional group-reactive crosslinking agent may be an aziridine oligomer having at least three aziridine groups. The functional group-reactive crosslinking agent may be present, by way of example, in an amount of from about 1 to about 8 percent by weight, based on the amount of the functional group-containing latex.

The present invention further provides a method of increasing the wet strength of a creped sheet; the method involves providing a sheet which includes cellulosic fibers, which sheet has a first side and a second side; applying a first low temperature-curing latex adhesive binder composition to the first side of the sheet in a first fine, spaced-apart pattern occupying from about 20 to about 50 percent of the surface area of the sheet; adhering the first side of the sheet to a first creping surface; creping the sheet from the first creping surface; applying a second low temperature-curing adhesive binder composition to the second side of the sheet in a second fine, spaced-apart pattern occupying from about 20 to about 50 percent of the surface area of the sheet; adhering the second side of the sheet to a second creping surface; and creping the sheet from the second creping surface.

The sheet typically will have a basis weight of from about 40 gsm to about 100 gsm. The first low temperature-curing latex adhesive binder composition is adapted to adhere the sheet to the first creping surface and includes a first functional group-containing latex, a first functional group-reactive crosslinking agent, and a first volatile base. Similarly, the second low temperature-curing latex adhesive binder composition is adapted to adhere the sheet to the creping surface and comprises a second functional group-containing latex, a second functional group-reactive crosslinking agent, and a second volatile base. The first and second creping surfaces are heated at temperatures no greater than about 100° C. The low temperature-curing latex adhesive binder composition is adapted to have cured to a level, by the time the sheet is removed from the creping surface, which imparts to the creped sheet a cross-direction wet tensile strength which is at least about 50 percent that of an identical creped sheet which has been heated at about 150° C. for three minutes, in which the cross-direction wet tensile is tested in accordance with TAPPI Test Methods T494om-88 and T456om-87, and the cross-direction wet tensile strength of the creped sheet is at least about 50 grams per centimeter. The parameters described with previous methods also apply here.

Finally, the present invention provides a low temperature-curing latex adhesive binder composition suitable for use in a creping process. The composition includes a functional group-containing latex, a functional group-reactive crosslinking agent, and a volatile base. The functional group-containing latex, the functional group-reactive crosslinking agent, and the amount of the functional group-reactive crosslinking agent are adapted to provide a composition which is substantially cured during a creping process which utilizes temperatures no higher than about 1 00C.

By way of example, the functional groups of the functional group-containing latex may be carboxy groups. As an example, the functional group-containing latex may be a polyacrylate. Also by way of example, the functional group-reactive crosslinking agent may be an aziridine oligomer having at least three aziridine groups. The functional group-reactive crosslinking agent may be present in the composition in an amount of from about 1 to about 8 percent by weight, based on the amount of the functional group-containing latex. In addition, the composition may contain from about 0.2 to about 3 percent by weight, based on the amount of the functional group-containing latex, of a buffering acid catalyst. Examples of such buffering acid catalysts include ammonium salts of polycarboxylic acids. For example, the ammonium salt of a polycarboxylic acid may be ammonium citrate, ammonium maleate, or ammonium oxalate. The composition also may contain from about 0.3 to about 2 percent by weight, again based on the amount of the functional group-containing latex, of a latent acid catalyst which is a salt of a volatile base with a mineral acid. For example, the salt may be ammonium chloride.

DETAILED DESCRIPTION OF THE INVENTION

Figure 1:
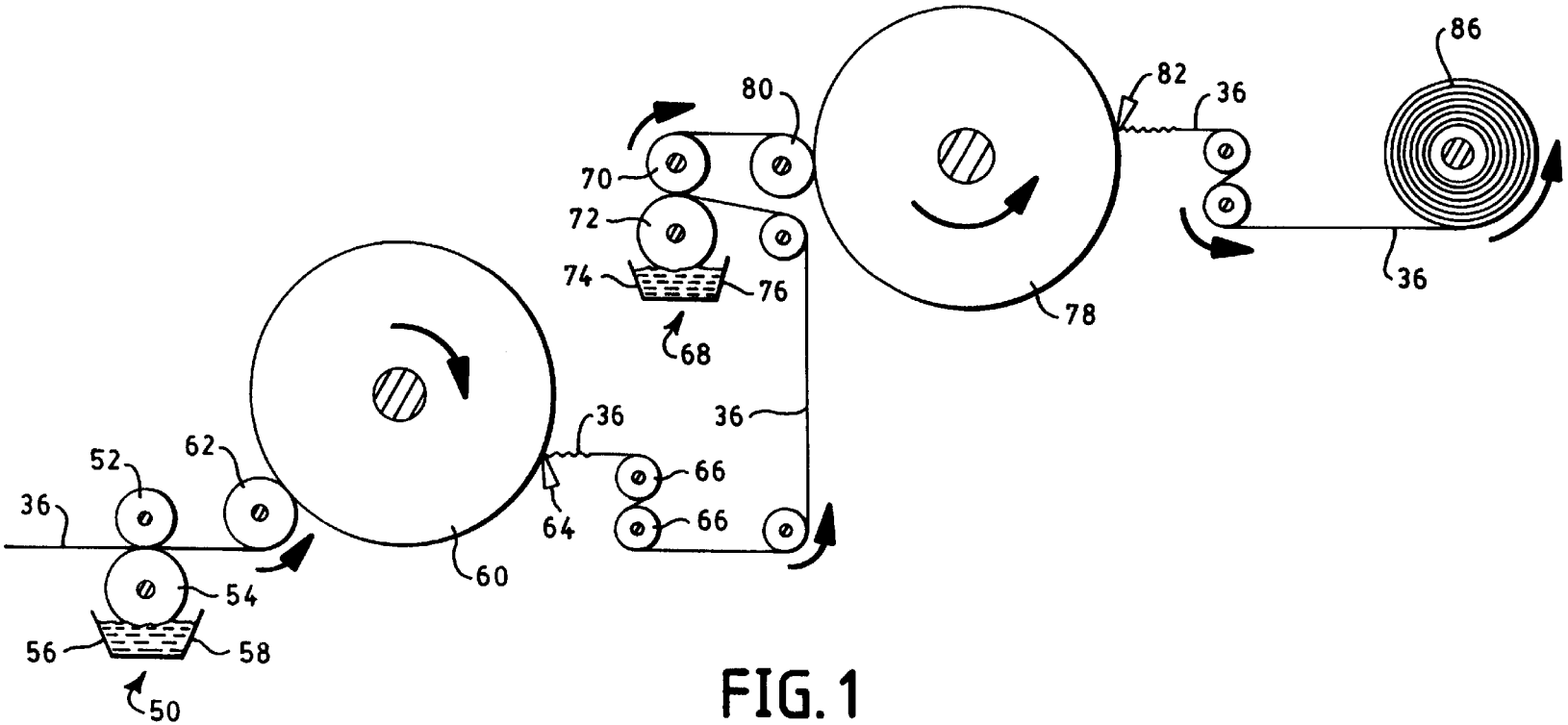
FIG. 1 is a schematic diagram of one embodiment of a process for double creping a paper web in accordance with the present invention.

As used herein, the term "cellulosic" refers or relates to a polysaccharide composed of glucose units. Sources of cellulosic fibers include, by way of illustration only, woods, such as softwoods and hardwoods; straws and grasses, such as rice, esparto, wheat, rye, and sabai; canes and reeds, such as bagasse; bamboos; woody stalks, such as jute, flax, kenaf, and cannabis; bast, such as linen and ramie; leaves, such as abaca and sisal; and seeds, such as cotton and cotton linters. Softwoods and hardwoods are the more commonly used sources of cellulosic fibers; the fibers may be obtained by any of the commonly used pulping processes, such as mechanical, chemimechanical, semichemical, and chemical processes. Examples of softwoods include, by way of illustration only, longleaf pine, shortleaf pine, loblolly pine, slash pine, Southern pine, black spruce, white spruce, jack pine, balsam fir, douglas fir, western hemlock, redwood, and red cedar. Examples of hardwoods include, again by way of illustration only, aspen, birch, beech, oak, maple and gum.

The term "latex" refers to the final product of an emulsion polymerization in which very small particles of polymer are suspended in an aqueous medium; such polymerization involves a colloidal suspension. A latex typically is prepared by the radical chain polymerization of one or more unsaturated monomers which are in the form of emulsions. The phrases "functional group-containing polymer in the form of a latex" and "functional group-containing latex" are synonymous and refer to the polymer per se which is dispersed in an aqueous medium. Unless stated otherwise, references to amounts of the polymer or the latex are on a dry weight basis.

The term "acid value" is used herein to mean the number of milligrams of potassium hydroxide required to neutralize the free acids present in one gram of the latex polymer. Titration typically is taken to a phenolphthalein end-point.

As used herein, the term "creping" refers to the formation of parallel micro-corrugations in the cross-direction of paper imposed by a doctor blade as the paper is peeled off a steam cylinder. Creping makes the paper softer and more extensible.

The term "functional group" is used herein to mean the part of a molecule where its chemical reactions occur. A molecule may have a single functional group, two or more functional groups of the same type or class, or two or more functional groups of two or more different types or classes.

The term "volatile base" is meant to include any base which is readily driven off, or volatilized, from a solution in which such base is present. A classic volatile base is ammonia. Other volatile bases include alkyl-substituted amines, such as methyl amine, ethyl amine or 1-aminopropane, dimethyl amine, and ethyl methyl amine. Desirably, the volatile base will have a boiling point no higher than about 50° C. More desirably, the volatile base will be ammonia.

As used herein, the term "wet tensile strength" refers to the tensile strength of a saturated sheet as determined in accordance with TAPPI Test Methods T494om-88 and T456om-87. The test is a measure of the ability of a cellulosic sheet to resist pulling forces when saturated with water. The results of the test are reported in grams per centimeter.

The term "synthetic polymer" refers to any polymer which does not occur naturally in the form in which it is used. The synthetic polymer typically will be a thermoplastic polymer, i.e., a polymer which softens when exposed to heat and returns to its original condition when cooled to room temperature. Examples of thermoplastic polymers include, by way of illustration only, end-capped polyacetals, such as poly(oxy-methylene) or polyformaldehyde, poly (trichloroacetaldehyde), poly(n-valeraldehyde), poly (acetaldehyde), and poly(propionaldehyde); acrylic polymers, such as polyacrylamide, poly(acrylic acid), poly (methacrylic acid), poly(ethyl acrylate), and poly(methyl methacrylate); fluorocarbon polymers, such as poly (tetrafluoroethyl-ene), perfluorinated ethylene-propylene copolymers, ethylene-tetrafluoroethylene copolymers, poly (chloro-trifluoroethylene), ethylene-chlorotrifluoroethylene copoly-mers, poly(vinylidene fluoride), and poly(vinyl fluoride); polyamides, such as poly(6-aminocaproic acid) or poly(ϵ-caprolactam), poly(hexamethylene adipamide), poly-(hexamethylene sebacamide), and poly(1 1-aminoundecanoic acid); polyaramides, such as poly (imino-1,3-phenyleneiminoisophthaloyl) or poly(m-phenylene isophthalamide); parylenes, such as poly-p-xylylene and poly(chloro-p-xylylene); polyaryl ethers, such as poly(oxy-2,6-dimethyl-1,4-phenylene) or poly(p-phenylene oxide); polyaryl sulfones, such as poly(oxy-1,4-phenylenesulfonyl-1,4-phenyleneoxy-1,4-phenylene-isopropylidene-1,4-phenylene) and poly(sulfonyl-1,4-phenyleneoxy-1,4-phenylenesulfonyl-4,4'-biphenylene); polycarbonates, such as poly(bisphenol A) or poly (carbonyidioxy-1,4-phenyl-eneisopropylidene-1,4-phenylene); polyesters, such as poly(ethylene terephthalate), poly(tetramethylene terephthalate), and poly(cyclo-hexylene-1,4-dimethylene terephthalate) or poly (oxymethylene-1,4-cyclohexylene-methyleneoxyterephthaloyl); polyaryl sulfides, such as poly (p-phenylene sulfide) or poly(thio-1,4-phenylene); polyimides, such as poly(pyromellitimido-1,4-phenylene); polyolefins, such as polyethylene, polypropylene, poly(l-butene), poly(2-butene), poly(l-pentene), poly(2-pentene), poly(3-methyl-1-pentene), and poly(4-methyl-1-pentene); vinyl polymers, such as poly(vinyl acetate), poly(vinylidene chloride), and poly(vinyl chloride); diene polymers, such as 1,2-poly-1,3-butadiene, 1,4-poly-1,3-butadiene, polyisoprene, and polychloroprene; polystyrenes; copolymers of the foregoing, such as acrylonitrile-butadiene-styrene (ABS) copolymers; and the like.

The method of the present invention involves providing a sheet which includes cellulosic fibers, which sheet has a first side and a second side; applying a low temperature-curing latex adhesive binder composition to the first side of the sheet in a fine, spaced-apart pattern occupying from about 20 to about 50 percent of the surface area of the sheet; adhering the first side of the sheet to a creping surface; and creping the sheet from the creping surface.

In general, the sheet employed in the present invention may be any cellulosic sheet known to those having ordinary skill in the art. The sheet may have a basis weight of from about 40 gsm to about 100 gsm. For example, the sheet may have a basis weight of from 45 gsm about to about 90 gsm. As another example, the sheet may have a basis weight of from about 50 gsm to about 70 gsm. The low temperature-curing latex adhesive binder composition is adapted to adhere the sheet to the creping surface and includes a functional group-containing latex, a functional group-reactive crosslinking agent, and a volatile base. In addition, the creping surface is heated at a temperature no greater than about 100° C. The low temperature-curing latex adhesive binder composition is adapted to have cured to a level, by the time the sheet is removed from the creping surface, which imparts to the creped sheet a cross-direction wet tensile strength which is at least about 50 percent that of an identical creped sheet which has been heated at about 150° C. for three minutes, in which the cross-direction wet tensile is tested in accordance with TAPPI Test Methods T494om-88 and T456om-87. In addition, the cross-direction wet tensile strength of the creped sheet is at least about 40 grams per centimeter. For example, the cross-direction wet tensile strength of the creped sheet may be from about 40 to about 450 grams per centimeter.

In certain embodiments, the sheet may include up to about 20 percent by weight, based on the dry weight of cellulosic fibers, of synthetic polymer fibers. For example, the sheet may include from about 5 to about 10 percent by weight, based on the dry weight of cellulosic fibers, of synthetic polymer fibers. By way of example, the synthetic polymer fibers may be polyester fibers or polyolefin fibers. Examples of polyolefin fibers include polyethylene and polypropylene fibers. However, other synthetic polymer fibers may be employed, if desired. In addition, mixtures of two or more synthetic polymer fibers of the same type or different types may be utilized.

The functional groups in the functional group-containing latex in general may be any functional group having one or more active hydrogen atoms. Examples of such groups include carboxy, amino, hydroxy, mercapto, sulfo, sulfino, and sulfamino groups, although such groups are not necessarily equally effective or desirable. The more commonly available, and also more desirable, functional groups are carboxy and amino. Examples of functional group-containing latexes include, by way of illustration only, carboxylated (carboxy-containing) polyacrylates, carboxylated nitrile-butadiene copolymers, carboxylated styrene-butadiene copolymers, carboxylated ethylene-vinylacetate copolymers, and polyurethanes. Some specific examples of commercially available carboxy group-containing latexes are shown in Table 1, below. In some embodiments, the functional groups of the functional group-containing latex will be carboxy groups. For example, the functional group-containing latex may have an acid value of from about 15 to about 50 mg KOH/g. As another example, the functional group-containing latex may be a polyacrylate.

TABLE I

Functional Group-Containing Latexes

| Polymer Type | Product Identification |
|---|---|
| Polyacrylates | Hycar ® 26083, 26084, 26322, 26469<br>B. F. Goodrich Company<br>Cleveland, Ohio<br>Rhoplex ® B-15, HA-8<br>Rohm and Haas Company<br>Philadelphia, Pennsylvania |
| Styrene-butadiene copolymers | Good-rite ™ 2570X59<br>B. F. Goodrich Company<br>Cleveland, Ohio |
| Ethylene-vinylacetate copolymers | Airflex ® 125<br>Air Products and Chemicals, Inc.<br>Napierville, Illinois |
| Nitrile-butadiene rubbers | Hycar ® 1571, 1572<br>B. F. Goodrich Company<br>Cleveland, Ohio |

The functional group-reactive crosslinking agent causes or results in the crosslinking or curing of the functional group-containing latex polymer. Suitable crosslinking agents achieve curing at ambient temperature (typically about 20°–25° C.) or slightly elevated temperatures (e.g., less than about 100° C.) in order to permit the elimination of a separate curing station for the reasons discussed hereinbefore. Some crosslinking agents are reactive at a pH which is neutral or acidic. In such cases, the composition must be kept at a pre-cure pH above about 8 until the sheet is creped. This is accomplished by the use of a volatile base. The volatile base remains in the composition until it is volatilized during the creping step. The temperature of the creping surface is selected to accelerate the loss of the volatile base from the composition present in the sheet without causing deleterious effects on the sheet, such as the melting of synthetic polymer fibers which may be present in the sheet. The loss of the volatile base from the composition causes a drop in the composition pH and triggers the reaction of the crosslinking agent with the functional groups present in the latex polymer.

The crosslinking agent is selected to be reactive with the functional groups resent in the latex polymer, as is well known to those having ordinary skill in the art. For example, when the functional groups present in the latex polymer are carboxy groups, examples of suitable crosslinking agents include Xama®-7, commercially available from B. F. Goodrich Company (Cleveland, Ohio), and Chemitite PZ-33, which is available from Nippon Shokubai Co. (Osaka, Japan). These crosslinking agents are aziridine oligomers with at least two aziridine functional groups. Thus, by way of example, the functional group-reactive crosslinking agent may be an aziridine oligomer having at least three aziridine groups. The functional group-reactive crosslinking agent may be present, also by way of example, in an amount of from about 1 to about 8 percent by weight, based on the amount of the functional group-containing latex.

The low temperature-curing latex adhesive binder composition also may include from about 0.2 to about 3 percent by weight, based on the amount of the functional group-containing latex, of a buffering acid catalyst. Examples of a buffering acid catalyst includes ammonium salts of polycarboxylic acids, such as, by way of illustration only, ammonium citrate, ammonium maleate, and ammonium oxalate. The buffering acid catalyst may be added to the composition as the free acid, if desired. Since the composition typically is used at a basic pH, the free acid generally will exist in the composition in salt form.

The composition also may contain from about 0.3 to about 2 percent by weight, again based on the amount of the functional group-containing latex, of a latent acid catalyst which is a salt of a volatile base with a mineral acid. For example, the latent acid catalyst may be present at a level of from about 0.5 to about 1 percent by weight. As another example, the salt may be ammonium chloride.

The present invention also provides a method of increasing the wet strength of a creped sheet, which method involves providing a sheet which includes cellulosic fibers, the sheet having a first side and a second side; applying a first low temperature-curing latex adhesive binder composition to the first side of the sheet in a fine, spaced-apart pattern occupying from about 20 to about 50 percent of the surface area of the sheet; applying a second low temperature-curing latex adhesive binder composition to the second side of the sheet in a fine, spaced-apart pattern occupying from about 20 to about 50 percent of the surface area of the sheet; adhering the second side of the sheet to a creping surface; and creping the sheet from the creping surface. The parameters described above also apply to this method.

The present invention further provides a method of increasing the wet strength of a creped sheet; the method involves providing a sheet which includes cellulosic fibers, which sheet has a first side and a second side; applying a first low temperature-curing latex adhesive binder composition to the first side of the sheet in a first fine, spaced-apart pattern occupying from about 20 to about 50 percent of the surface area of the sheet; adhering the first side of the sheet to a first creping surface; creping the sheet from the first creping surface; applying a second low temperature-curing adhesive binder composition to the second side of the sheet in a second fine, spaced-apart pattern occupying from about 20 to about 50 percent of the surface area of the sheet; adhering the second side of the sheet to a second creping surface; and creping the sheet from the second creping surface. Again, the parameters described hereinbefore apply to this method.

Finally, the present invention provides a low temperature-curing latex adhesive binder composition suitable for use in a creping process. The composition includes a functional group-containing latex, a functional group-reactive crosslinking agent, and a volatile base. The functional group-containing latex, the functional group-reactive crosslinking agent, and the amount of the functional group-reactive crosslinking agent are adapted to provide a composition which is substantially cured during a creping process which utilizes temperatures no higher than about 100° C.

By way of example, the functional groups of the functional group-containing latex may be carboxy groups. As an example, the functional group-containing latex may be a polyacrylate. Also by way of example, the functional group-reactive crosslinking agent may be an aziridine oligomer having at least three aziridine groups. The functional group-reactive crosslinking agent may be present in the composition in an amount of from about 1 to about 8 percent by weight, based on the amount of the functional group-containing latex. In addition, the composition may contain a buffering acid catalyst and/or a latent acid catalyst as desired hereinabove.

Referring now to FIG. 1, there is shown an exemplary embodiment of a process in which a low temperature ahesive binder composition is applied to both sides of a sheet 36 and both sides of the sheet are creped.

A sheet 36 made according to any known process is passed through a first binder composition application station, generally 50. The station 50 includes a nip formed by a smooth rubber press roll 52 and a patterned rotogravure roll 54. The rotogravure roll 54 is in communication with a reservoir 56 containing a first binder composition 58. The rotogravure roll 54 applies a first binder composition 58 to one side of the sheet 36 in a first preselected pattern.

The sheet 36 then is pressed into contact with a first creping drum 60 by a press roll 62. The sheet adheres to the creping drum 60 in those locations where the binder composition has been applied. If desired, the creping drum 60 may be heated for promoting attachment between the sheet and the surface of the drum 60 and for partially drying the sheet. In general, the temperature of the drum surface will be no greater than about 100° C.

Once adhered to the creping drum 60, the sheet 36 is brought into contact with a creping blade 64. Specifically, the sheet 36 is removed from the creping roll 60 by the action of the creping blade 64, performing a first controlled pattern crepe on the sheet. The first-creped sheet 36 can be advanced by the pull rolls 66 to a second binder composition application station, generally 68. The station 68 includes a transfer roll 70 in contact with a rotogravure roll 72, which is in communication with a reservoir 74 containing a second binder composition 76. Similar to station 50, the second binder composition 76 is applied to the opposite side of the sheet 36 in a second preselected pattern which may be the same as or different from the first preselected pattern. Once the second binder composition is applied, the sheet 36 is adhered to a second creping roll 78 by a press roll 80. The sheet 36 is carried on the surface of the creping drum 78 for a distance and then removed therefrom by the action of a second creping blade 82. The second creping blade 82 performs a second controlled pattern creping operation on the second side of the sheet. The sheet 36 then may be wound up on a roll 86.

The present invention is further described by the examples which follow. Such examples, however, are not to be construed as limiting in any way either the spirit or the scope of the present invention.

EXAMPLES 1–26

In each case, the sheet was a conventional debonded paper sheet containing about 70 percent by weight of southern softwood Kraft pulp and about 30 percent by weight (both on a dry weight basis) of southern hardwood Kraft pulp. A sheet sample was printed with a latex adhesive binding composition on both sides. In each case, the composition was applied according to a ¼ inch diamond pattern in combination with an over pattern of dots. The composition was applied to each surface of the sample in an amount of 5 percent by weight. A latex based on a polymer lacking functional groups was employed as a control. The various latex adhesive binder compositions employed in the examples are described below and the compositions are summarized in Table 1. Solids contents are the percent solids as employed in the printing and creping processes.

Latex A

Latex A served as a control and was a self-crosslinking ethylene-vinyl acetate copolymer from Air Products and Chemicals, Inc., Allentown, Pennsylvania. The latex had a solids content of 31 percent by weight.

Latex B

This latex was a carboxy group-containing polyacrylate available from B. F. Goodrich Company, Cleveland, Ohio. The material had a solids content of 30 percent by weight, an acid value of 31 mg KOH/g, and a viscosity or 65 centipoise (0.065 pascal second or Pa s).

Latex C

Latex C was similar to Latex B and available from the same source, except that the acid value was 38 mg KOH/g.

Latex D

This latex was similar to Latex C and available from the same source.

Latex E

Latex E was similar to Latex C and available from the same source, except that the solids content was 38 percent and the viscosity was 62 centipoise (0.062 Pa s).

Latexes B-E, inclusive were variations of Air Product's Hycar® 26410.

TABLE 1

Summary of Latex Adhesive Binder Compositions

| Example | Latex | Xama ®-7[a] | Ammonium Citrate |
|---|---|---|---|
| 1 | A | — | — |
| 2 | B | 3 | — |
| 3 | B | 3 | — |
| 4 | B | 5 | — |
| 5 | B | 5 | 1 |
| 6 | B | 5 | 1 |
| 7 | C | 5 | — |
| 8 | C | 5 | — |
| 9 | C | 5 | 0.75 |

TABLE 1-continued

Summary of Latex Adhesive Binder Compositions

| Example | Latex | Xama ®-7[a] | Ammonium Citrate |
|---|---|---|---|
| 10 | C | 5 | 0.75 |
| 11 | D | 5 | — |
| 12 | D | 5 | — |
| 13 | D | 5 | — |
| 14 | D | 5 | 1 |
| 15 | D | 5 | 1 |
| 16 | D | 5 | 1 |
| 17 | D | 5 | 1 |
| 18 | D | 5 | 1 |
| 19 | D | 5 | 1 |
| 20 | D | 3 | — |
| 21 | D | 3 | — |
| 22 | D | 3 | 0.5 |
| 23 | D | 3 | 0.5 |
| 24 | D | 3 | 0.5 |
| 25 | E | 5 | 0.7 |
| 26 | E | 5 | 0.7 |

[a]Percent by weight, based on latex dry weight.

Each sheet was creped on each side according to the procedure shown in FIG. 1. The printing and creping conditions are summarized in Table 2.

TABLE 2

Summary of Printing and Creping

| Example | Print Pressure[a] | Blade Pressure[a] | Machine Speed[b] | Drum Temp.[c] | Line Crepe[d] |
|---|---|---|---|---|---|
| 1 | 30 | 25 | 250 | 88 | 9 |
| 2 | 20 | 25 | 100 | 93 | 9 |
| 3 | 20 | 25 | 150 | 93 | 9 |
| 4 | 20 | 25 | 150 | 93 | 9 |
| 5 | 20 | 25 | 100 | 93 | 9 |
| 6 | 20 | 25 | 150 | 93 | 9 |
| 7 | 20 | 25 | 100 | 93 | 9 |
| 8 | 20 | 25 | 150 | 93 | 9 |
| 9 | 20 | 25 | 100 | 93 | 9 |
| 10 | 20 | 25 | 150 | 93 | 9 |
| 11 | 20 | 25 | 100 | 93 | 9 |
| 12 | 20 | 25 | 100 | 93 | 15 |
| 13 | 20 | 25 | 150 | 93 | 9 |
| 14 | 20 | 15 | 100 | 82 | 9 |
| 15 | 20 | 15 | 150 | 82 | 9 |
| 16 | 20 | 15 | 100 | 93 | 9 |
| 17 | 20 | 15 | 150 | 93 | 9 |
| 18 | 20 | 15 | 100 | 104 | 9 |
| 19 | 20 | 15 | 150 | 104 | 9 |
| Example | Print Pressure[a] | Blade Pressure[b] | Machine Speed[c] | Drum Temp.[d] | Line Crepe[e] |
| 20 | 20 | 15 | 100 | 93 | 9 |
| 21 | 20 | 15 | 150 | 93 | 9 |
| 22 | 20 | 15 | 100 | 93 | 9 |
| 23 | 20 | 15 | 150 | 93 | 9 |
| 24 | 30 | 15 | 150 | 93 | 9 |
| 25 | 30 | 15 | 125 | 93 | 9 |
| 26 | 30 | 15 | 100 | 93 | 9 |

[a]Pressure in pounds per square inch (to convert to kilograms per square meter, multiply by 703.07).
[b]Pressure in pounds per linear inch (to convert to kg per linear cm, multiply by 0.17874).
[c]In feet per minute (to convert to meters per second, multiply by 0.00508).
[d]In ° C.
[e]In percent.

The creped samples were tested for a variety of properties in accordance with procedures which are well known to those having ordinary skill in the art. Tensile tests were carried out on a Thwing-Albert tensile tester. The results of the tests are summarized in Tables 3 and 4.

TABLE 3

Summary of Test Results

| Example | MDTS[a] | MDS[b] | CDTS[c] | CDS[d] | CDWTS[e] |
|---|---|---|---|---|---|
| 1 | 52.6 | 19.1 | 25.0 | 9.4 | 14.3 |
| 2 | — | — | 40.3 | 7.7 | 12.2 |
| 3 | 63 | 24 | 30.6 | 8.9 | 7.3 |
| 4 | 72.2 | — | 35.7 | 7.1 | 11.5 |
| 5 | 88.5 | 34.2 | 46.8 | 6.7 | 15.2 |
| 6 | 70.6 | 28.5 | 39.4 | 7.2 | 12.3 |
| 7 | 67.5 | 35.4 | 36 | 7.3 | 10.2 |
| 8 | 59.9 | 33.5 | 32.6 | 6.6 | 10.1 |
| 9 | 70.2 | 35 | 41.2 | 5.5 | 15.2 |
| 10 | 60.0 | 29.3 | 35.3 | 6.7 | 10.6 |
| 11 | 67.9 | 24.0 | 33.2 | 10.1 | 12.3 |
| 12 | 68.8 | 32.6 | — | — | 11.9 |
| 13 | 59.2 | 26.0 | 25.5 | 8.2 | 10.3 |
| 14 | 69.2 | 23.4 | 29.8 | 8.2 | 10.9 |
| 15 | — | — | — | — | 9.7 |
| 16 | 62.5 | 32.2 | 30.4 | 6.1 | 10.9 |
| 17 | — | — | — | — | 13.9 |
| 18 | 76.9 | 36.0 | 35.6 | 6.5 | 11.2 |
| 19 | — | — | — | — | 11.3 |
| 20 | 68.7 | 36.9 | 29.2 | 8.6 | 11.5 |
| 21 | 54.4 | 35.8 | — | — | 10.5 |
| 22 | 60.7 | 34.4 | 28.5 | 7.6 | 11.1 |
| 23 | 53.2 | 35.8 | 27.3 | 9.1 | 9.5 |
| 24 | 64.2 | 37.4 | — | — | 10.6 |
| 25 | 75.8 | 27.8 | 30.7 | 8.5 | 11.6 |
| 26 | 78.8 | 29.5 | 32.5 | 7.9 | 12.4 |

[a]Machine direction tensile strength in ounces per inch (to convert to grams per centimeter, multiply by 11.16).
[b]Machine direction stretch in percent.
[c]Cross direction tensile strength in ounces per inch (to convert to grams per centimeter, multiply by 11.16).
[d]Cross direction stretch in perecent.
[e]Cross direction wet tensile strength in ounces per inch (to convert to grams per centimeter, multiply by 11.16).

TABLE 4

Summary of Test Results

| Example | Cured CDWTS[a] | Cure[b] | BW[c] | Bulk[d] |
|---|---|---|---|---|
| 1 | 52.6 | 19.1 | 14.7 | 9.4 |
| 2 | — | — | 68.4 | 7.7 |
| 3 | 63 | 24 | 51.9 | 8.9 |
| 4 | 72.2 | — | 60.6 | 7.1 |
| 5 | 88.5 | 34.2 | 79.4 | 6.7 |
| 6 | 70.6 | 28.5 | 66.9 | 7.2 |
| 7 | 67.5 | 35.4 | 61.1 | 7.3 |
| 8 | 59.9 | 33.5 | 55.3 | 6.6 |
| 9 | 70.2 | 35 | 69.9 | 5.5 |
| 10 | 60.0 | 29.3 | 59.9 | 6.7 |
| 11 | 67.9 | 24.0 | 56.3 | 10.1 |
| 12 | 68.8 | 32.6 | — | — |
| 13 | 59.2 | 26.0 | 43.3 | 8.2 |
| 14 | 69.2 | 23.4 | 50.6 | 8.2 |
| 15 | — | — | — | — |
| 16 | 62.5 | 32.2 | 51.6 | 6.1 |
| 17 | — | — | — | — |
| 18 | 76.9 | 36.0 | 60.4 | 6.5 |
| 19 | — | — | — | — |
| 20 | 68.7 | 36.9 | 49.5 | 8.6 |
| 21 | 54.4 | 35.8 | — | — |
| 22 | 60.7 | 34.4 | 48.4 | 7.6 |
| 23 | 53.2 | 35.8 | 46.3 | 9.1 |
| 24 | 64.2 | 37.4 | — | — |

TABLE 4-continued

Summary of Test Results

| Example | Cured CDWTS[a] | Cure[b] | BW[c] | Bulk[d] |
|---|---|---|---|---|
| 25 | 75.8 | 27.8 | 52.1 | 8.5 |
| 26 | 78.8 | 29.5 | 55.1 | 7.9 |

[a]Cross direction wet tensile strength in ounces per inch (to convert to grams per centimeter, multiply by 11.16) after curing at 150° C. for three minutes.
[b]Cure at the reel as a percentage of the cure achieved upon heating (previous column).
[c]Basis weight in gsm.
[d]Bulk of 24 plies.

From Tables 3 and 4 it is seen that maximum low temperature cures generally were obtained with the use of a crosslinking agent and higher latex polymer acid values. Higher acid values also resulted in higher levels of adhesion of the sheet to the creping surface.

While the specification has been described in detail with respect to specific embodiments thereof, it will be appreciated by those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A method of increasing the wet strength of a creped sheet, the method comprising:

providing a sheet comprising cellulosic fibers, which sheet has a first side and a second side;

applying a low temperature-curing latex adhesive binder composition to the first side of the sheet in a fine, spaced-apart pattern occupying from about 20 to about 50 percent of the surface area of the sheet;

adhering the first side of the sheet to a creping surface; and creping the sheet from the creping surface; wherein the sheet has a basis weight of from about 40 to about 100 grams per square meter;

the low temperature-curing latex adhesive binder composition is adapted to adhere the sheet to the creping surface and comprises a functional group-containing latex, a functional group-reactive crosslinking agent, and a volatile base;

and wherein the low temperature-curing latex adhesive binder composition is maintained at a pre-cure pH of above about 8.0 until the sheet is creped;

the creping surface is heated at a temperature no greater than about 100° C.;

when the sheet is removed from the creping surface, the low temperature-curing latex adhesive binder composition has cured to a level which imparts to the creped sheet a cross-direction wet tensile strength which is at least about 50 percent that of an identical creped sheet which has been heated at about 150° C. for three minutes, in which the cross-direction wet tensile is tested in accordance with TAPPI Test Methods T494om-88 and T456om-87; and the cross-direction wet tensile strength of the creped sheet is at least about 40 grams per centimeter.

2. The method of claim 1, in which the sheet includes up to about 20 percent by weight, based on the dry weight of cellulosic fibers, of synthetic polymer fibers.

3. The method of claim 2, in which the sheet includes from about 5 to about 10 percent by weight, based on the dry weight of cellulosic fibers, of synthetic polymer fibers.

4. The method of claim 2, in which the synthetic polymer fibers are polyester or polyolefin fibers.

5. The method of claim 4, in which the polyolefin fibers are polyethylene or polypropylene fibers.

6. The method of claim 1, in which the functional groups of the functional group-containing latex are carboxy groups.

7. The method of claim 6, in which the functional group-containing latex has an acid value of from about 15 to about 50 milligrams of potassium hydroxide per gram.

8. The method of claim 7, in which the functional group-containing latex is a polyacrylate.

9. The method of claim 6, in which the functional group-reactive crosslinking agent is an aziridine oligomer having at least three aziridine groups.

10. The method of claim 9, in which the functional group-reactive crosslinking agent is present in an amount of from about 1 to about 8 percent by weight, based on the amount of the functional group-containing latex.

11. A method of increasing the wet strength of a creped sheet, the method comprising:

providing a sheet comprising cellulosic fibers, which sheet has a first side and a second side;

applying a first low temperature-curing latex adhesive binder composition to the first side of the sheet in a fine, spaced-apart pattern occupying from about 20 to about 50 percent of the surface area of the sheet;

applying a second low temperature-curing latex adhesive binder composition to the second side of the sheet in a fine, spaced-apart pattern occupying from about 20 to about 50 percent of the surface area of the sheet;

adhering the second side of the sheet to a creping surface; and creping the sheet from the creping surface; wherein the sheet has a basis weight of from about 40 to about 100 grams per square meter;

the first low temperature-curing latex adhesive binder composition comprises a first functional group-containing latex, a first functional group-reactive crosslinking agent, and a first volatile base;

the second low temperature-curing latex adhesive binder composition is adapted to adhere the sheet to the creping surface and comprises a second functional group-containing latex, a second functional group-reactive crosslinking agent, and a second volatile base;

and wherein the first and second low temperature-curing latex adhesive binder compositions are maintained at a pre-cure pH above about 8.0 until the sheet is creped;

the creping surface is heated at a temperature no greater than about 100° C.;

when the sheet is removed from the creping surface, the first and second low temperature-curing latex adhesive binder compositions have cured to a level which imparts to the creped sheet a cross-direction wet tensile strength which is at least about 50 percent that of an identical creped sheet which has been heated at about 150° C. for three minutes, in which the cross-direction wet tensile is tested in accordance with TAPPI Test Methods T494om-88 and T456om-87; and the cross-direction wet tensile strength of the creped sheet is at least about 60 grams per centimeter.

12. The method of claim 11, in which the sheet includes up to about 20 percent by weight, based on the dry weight of cellulosic fibers, of synthetic polymer fibers.

13. The method of claim 12, in which the sheet includes from about 5 to about 10 percent by weight, based on the dry weight of cellulosic fibers, of synthetic polymer fibers.

14. The method of claim 12, in which the synthetic polymer fibers are polyester or polyolefin fibers.

15. The method of claim 14, in which the polyolefin fibers are polyethylene or polypropylene fibers.

16. The method of claim 11, in which the functional groups of each of the first and second functional group-containing latexes are carboxy groups.

17. The method of claim 16, in which each of the first and second-functional group-containing latexes has an acid value of from about 15 to about 50 milligrams of potassium hydroxide per gram.

18. The method of claim 17, in which each of the first and second functional group-containing latexes is a polyacrylate.

19. The method of claim 16, in which each of the first and second functional group-reactive crosslinking agents is an aziridine oligomer having at least three aziridine groups.

20. The method of claim 19, in which each of the first and second functional group-reactive crosslinking agents is present in an amount of from about 1 to about 8 percent by weight, based on the amount of the respective functional group-containing latex.

21. A method of increasing the wet strength of a creped sheet, the method comprising:

providing a sheet comprising cellulosic fibers, which sheet has a first side and a second side;

applying a first low temperature-curing latex adhesive binder composition to the first side of the sheet in a first fine, spaced-apart pattern occupying from about 20 to about 50 percent of the surface area of the sheet;

adhering the first side of the sheet to a first creping surface;

creping the sheet from the first creping surface;

applying a second low temperature-curing adhesive binder composition to the second side of the sheet in a second fine, spaced-apart pattern occupying from about 20 to about 50 percent of the surface area of the sheet;

adhering the second side of the sheet to a second creping surface; and creping the sheet from the second creping surface; wherein the sheet has a basis weight of from about 40 to about 100 grams per square meter;

the first low temperature-curing latex adhesive binder composition is adapted to adhere the sheet to the first creping surface and comprises a first functional group-containing latex, a first functional group-reactive crosslinking agent, and a first volatile base;

the second low temperature-curing latex adhesive binder composition is adapted to adhere the sheet to the second creping surface and comprises a second functional group-containing latex, a second functional group-reactive crosslinking agent,. and a second volatile base;

and wherein the first and second low temperature-curing latex adhesive binder compositions are maintained at a pre-cure pH above about 8.0 until the sheet is creped;

the first and second creping surfaces are heated at temperatures no greater than about 100° C.;

when the sheet is removed from the second creping surface, the first and second low temperature-curing latex adhesive binder compositions have cured to a level which imparts to the creped sheet a cross-direction wet tensile strength which is at least about 50 percent that of an identical creped sheet which has been heated at about 150° C. for three minutes, in which the cross-direction wet tensile is tested in accordance with TAPPI Test Methods T494om-88 and T456om-87; and the cross-direction wet tensile strength of the creped sheet is at least about 50 grams per centimeter.

22. The method of claim 21, in which the sheet includes up to about 20 percent by weight, based on the dry weight of cellulosic fibers, of synthetic polymer fibers.

23. The method of claim 22, in which the sheet includes from about 5 to about 10 percent by weight, based on the dry weight of cellulosic fibers, of synthetic polymer fibers.

24. The method of claim 23, in which the synthetic polymer fibers are polyester or polyolefin fibers.

25. The method of claim 24, in which the polyolefin fibers are polyethylene or polypropylene fibers.

26. The method of claim 21, in which the functional groups of the first and second functional group-containing latexes are carboxy groups.

27. The method of claim 26, in which the first and second functional group-containing latexes are polyacrylates.

28. The method of claim 21, in which the first and second functional group-reactive crosslinking agents are aziridine oligomers having at least three aziridine groups.

29. The method of claim 28, in which each of the first and second functional group-reactive crosslinking agents is present in an amount of from about 1 to about 8 percent by weight, based on the amount of the respective functional group-containing latex.

* * * * *